United States Patent [19]

Fukutome et al.

[11] Patent Number: 4,493,560

[45] Date of Patent: Jan. 15, 1985

[54] ACOUSTIC ALARM DEVICE FOR WATCHES

[75] Inventors: Satoru Fukutome; Hideo Hatanaka; Motoyuki Saito, all of Tanashi, Japan

[73] Assignee: Citizen Watch Co., Ltd., Tokyo, Japan

[21] Appl. No.: 392,637

[22] Filed: Jun. 28, 1982

Related U.S. Application Data

[62] Division of Ser. No. 164,769, Jun. 30, 1980, Pat. No. 4,351,041.

[30] Foreign Application Priority Data

| | | | |
|---|---|---|---|
| Jun. 30, 1979 | [JP] | Japan | 54-89820 |
| Jun. 30, 1979 | [JP] | Japan | 54-89821 |
| Jun. 30, 1979 | [JP] | Japan | 54-89822 |

[51] Int. Cl.[3] ..... G04C 23/02; G04C 21/16

[52] U.S. Cl. ..... 368/88; 368/250

[58] Field of Search ..... 368/72-75, 368/250, 255, 315, 88; 340/384 E, 388

[56] References Cited

U.S. PATENT DOCUMENTS

| | | | |
|---|---|---|---|
| 3,777,472 | 12/1973 | Iinuma | 368/255 |
| 3,879,931 | 4/1975 | Yasuda et al. | 368/255 |
| 3,906,713 | 9/1975 | Suda et al. | 368/255 |
| 4,197,697 | 4/1980 | Mori et al. | 368/315 |
| 4,206,590 | 6/1980 | Fukutomr et al. | 368/272 |
| 4,250,573 | 2/1981 | Saito | 340/387 |

FOREIGN PATENT DOCUMENTS

| | | | |
|---|---|---|---|
| 52-58959 | 5/1977 | Japan | 368/250 |
| 52-75376 | 6/1977 | Japan | 368/250 |

*Primary Examiner*—Vit W. Miska

*Attorney, Agent, or Firm*—Birch, Stewart, Kolasch & Birch

[57] ABSTRACT

An alarm device for a watch mounted in a recess provided in an upper portion of the watch case, for example in the upper portion of the band connecting portion of the watch case. The alarm device comprises a vibration plate secured to the bottom of the recess, a watertight sealing member, a cover for the vibration plate and securing means such as a screw for fixing the vibration plate to the recess through the watertight sealing member.

1 Claim, 9 Drawing Figures

ACOUSTIC ALARM DEVICE FOR WATCHES

This application is a divisional of copending application Ser. No. 164,769, filed on June 30, 1980 now U.S. Pat. No. 4,351,041.

BACKGROUND OF THE INVENTION

The present invention relates to an acoustic alarm device for watches.

It is desirable for miniaturizing a watch to provide the acoustic alarm device in an upper portion of the watch case which is not used for the watch movement or module, such as a band connecting portion of the watch case. However, the thickness of the alarm device must be decreased so as to be mounted in a thin portion of the watch case and moreover watertight means must be provided. Further, the alarm device must be constructed to be inserted into the watch case from the upper side thereof.

SUMMARY OF THE INVENTION

An object of the present invention is to provide a compact alarm device having perfect watertightness. Another object of the present invention is to provide an alarm device which may be mounted on a watch case.

Other objects will become more apparent from the following description with reference to the accompanying drawings.

DESCRIPTION OF PREFERRED EMBODIMENTS

Figure 1:
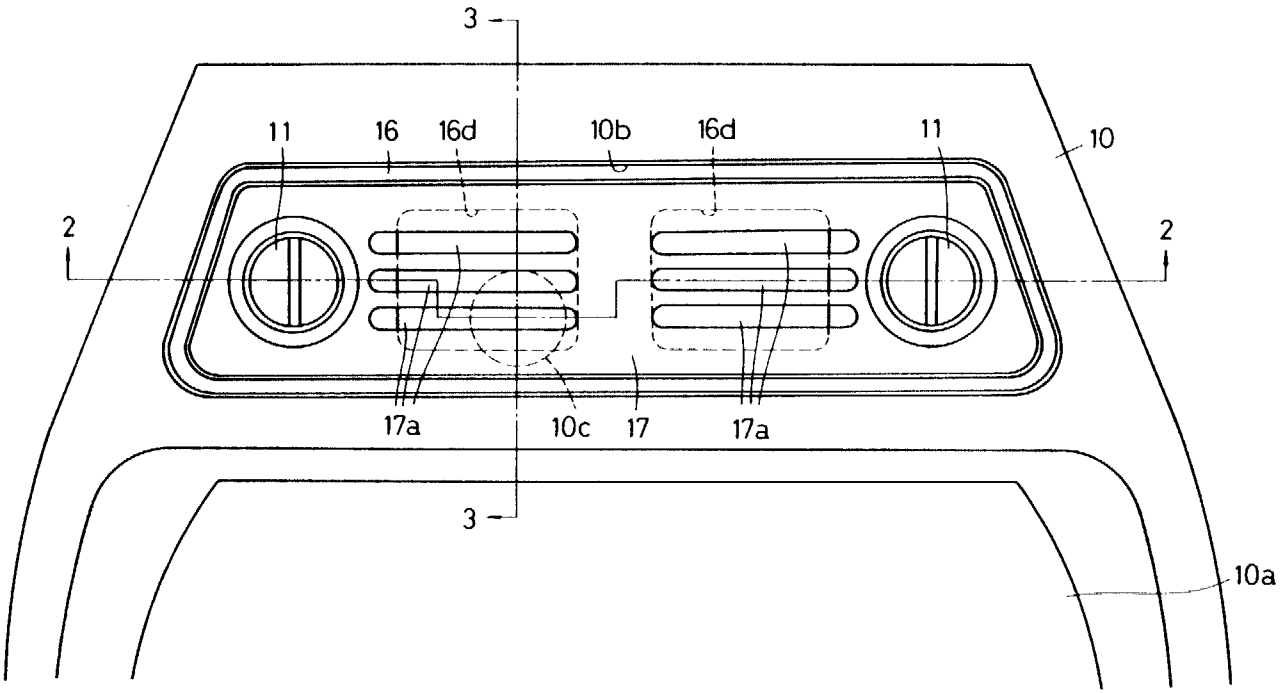
FIG. 1 is a front view of an acoustic alarm device of the present invention.
Figure 2:
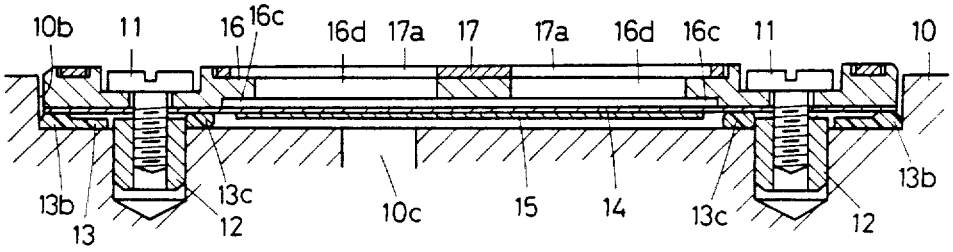
FIG. 2 is a sectional view taken along the line 2—2 of FIG. 1.
Figure 3:
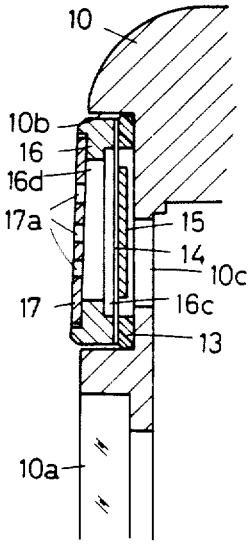
FIG. 3 is a sectional view taken along the line 3—3 of FIG. 1.

Referring to FIGS. 1 to 3, numeral 10 designates a watch case having a module (not shown) therein and a display portion 10*a* on an upper portion. In an upper portion thereof of a band-connecting portion of the watch case, an oblong recess 10*b* is provided for mounting an alarm device. A communication hole 10*c* is provided in the bottom of the recess 10*b* for electrical connection between the module in the watch case 10 and the alarm device in the recess. In the bottom of the recess 10*b*, threaded pipes 12 are securely provided at opposite ends of the bottom.

Figure 4:
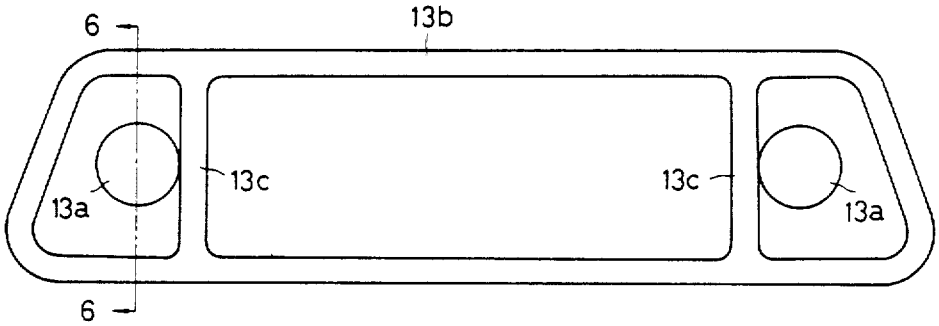
FIG. 4 is a front view of the packing.
Figure 5:
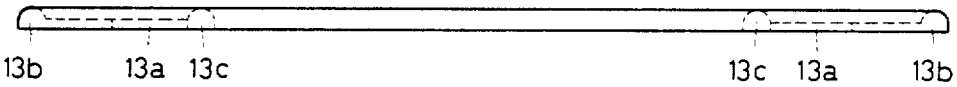
FIG. 5 is a side view of the packing.
Figure 6:
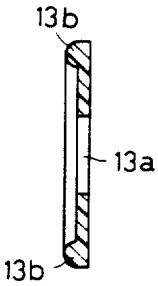
FIG. 6 is a sectional view taken along the line 6—6 of FIG. 4.

Numeral 13 designates a packing. As shown in FIGS. 4 to 6, the packing 13 comprises a peripheral portion 13*b* and a pair of inner portions 13*c*, each of which surrounding a hole 13*a*. The packing has a watertight effect for the alarm device. Numeral 14 designates a vibration plate having a piezo-electric element 15 securely fixed to the underside thereof and having a pair of holes for securing screws 11.

Figure 7:
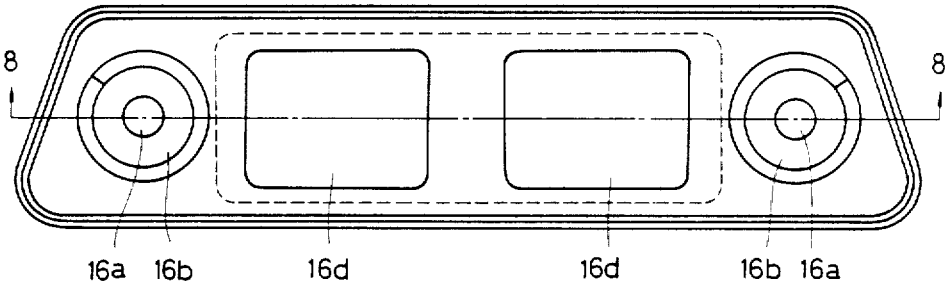
FIG. 7 is a front view of a cover.
Figure 8:
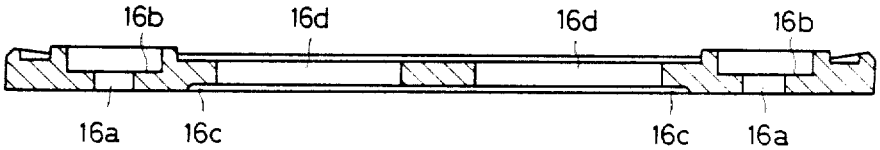
FIG. 8 is a sectional view taken along the line 8—8 of FIG. 7.
Figure 9:
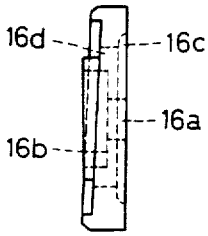
FIG. 9 is a right side view of the cover.

As shown in FIGS. 7 to 9, a cover 16 has holes 16*a* and recesses 16*b* for screws 11, and has on the underside an escape portion 16*c* to free an inner portion of the vibration plate 14. In the escape portion 16*c*, openings 16*d* are formed for transmitting the alarm sound therethrough. An ornament plate 17 is securely fixed on the cover 16 with adhesives or the like. The ornament plate has apertures 17*a* conveniently provided to correspond to openings 16*d*.

Therefore, assembly of the device described above is accomplished by putting the packing 13 on the bottom of the recess 10*b*, mounting the cover 16 subsequently to the vibration plate 14 on the packing 13 and, fastening the engagement between screws 11 and screw pipes 12.

Thus, by the simple construction and flat disposition of elements of the alarm device, a compact alarm device can be made. Since the vibration plate 14 and the cover 16 are secured on the case 10 with screws 11 which extend through the packing 13*a*, watertight seal between the case 10 and the cover 16 is effected by the peripheral portion 13*b* of the packing 13 and the watertightness of the portion around the screws 11 to the inside of the watch case is perfectly ensured by the inner portions 13*c* of the packing 13.

What is claimed is:

1. In an alarm device for a watch including a watch case, a vibration plate for producing an alarm sound, and a watertight sealing packing for maintaining the inside of said vibration plate in a watertight state, the improvement which comprises:

a recess provided in an upper portion of the body of said watch case, said recess containing holes provided in the bottom thereof, threaded pipes fixedly disposed in said holes, each of said threaded pipes projecting from the bottom thereof, said watertight sealing packing being engaged with said recess and provided with holes for receiving the projected portion of said threaded pipes and said vibration plate being engaged with said watertight sealing packing and disposed adjacent to the bottom of said recess, cover means provided for said vibration plate, said cover means having at least one sound emanating hole; and screw means engaged in said threaded pipes for securing said vibration plate and said cover means to said recess, whereby the entirety of the alarm device is embedded in said recess.

* * * * *